US008033326B2

(12) United States Patent
Dakhoul

(10) Patent No.: US 8,033,326 B2
(45) Date of Patent: Oct. 11, 2011

(54) HEAT EXCHANGER

(75) Inventor: Youssef M. Dakhoul, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 963 days.

(21) Appl. No.: 11/960,946

(22) Filed: Dec. 20, 2007

(65) Prior Publication Data

US 2008/0149318 A1 Jun. 26, 2008

Related U.S. Application Data

(63) Continuation-in-part of application No. 11/642,147, filed on Dec. 20, 2006, now abandoned.

(51) Int. Cl.
*F28F 3/08* (2006.01)

(52) U.S. Cl. ..... 165/167; 165/174

(58) Field of Classification Search ..... 165/167, 165/166, 174, DIG. 365, DIG. 483
See application file for complete search history.

(56) References Cited

U.S. PATENT DOCUMENTS

| | | | | |
|---|---|---|---|---|
| 1,915,805 | A | | 6/1933 | Sutcliffe |
| 2,248,933 | A | | 7/1941 | Astle |
| 2,528,013 | A | * | 10/1950 | Morris ..... 165/167 |
| 3,404,733 | A | | 10/1968 | Pottharst |
| 4,183,403 | A | | 1/1980 | Nicholson |
| 4,352,393 | A | | 10/1982 | Vidal-Meza |
| 4,434,845 | A | | 3/1984 | Steeb |
| 4,569,391 | A | | 2/1986 | Hulswitt et al. |
| 4,815,534 | A | | 3/1989 | Fuerschbach |
| 4,893,673 | A | * | 1/1990 | Rosman et al. ..... 165/167 |
| 5,392,849 | A | | 2/1995 | Matsunaga et al. |
| 5,718,286 | A | | 2/1998 | Damsohn et al. |
| 5,829,517 | A | | 11/1998 | Schmid et al. |
| 5,911,273 | A | | 6/1999 | Brenner et al. |
| 6,142,222 | A | * | 11/2000 | Kang et al. ..... 165/148 |
| 6,179,051 | B1 | | 1/2001 | Ayub |
| 6,244,334 | B1 | | 6/2001 | Wu et al. |
| 6,675,878 | B2 | | 1/2004 | Haasch et al. |
| 6,830,736 | B1 | | 12/2004 | Lamla et al. |
| 6,883,502 | B2 | | 4/2005 | Nechvatal |
| 2001/0030041 | A1 | | 10/2001 | Boneberg et al. |

* cited by examiner

*Primary Examiner* — Teresa Walberg
(74) *Attorney, Agent, or Firm* — William Beckman

(57) ABSTRACT

A heat exchanger is provided. The heat exchanger includes a stack assembly with a plurality of plates and a plurality of frames arranged in an alternating stacked relationship with the plates along a stack direction. The stack assembly also includes a plurality of foam blocks disposed within the plurality of frames. A first and second fluid flow path extend through the stack assembly, with the first fluid flow path in thermal contact with the second fluid flow path and fluidly isolated from the second fluid flow path.

20 Claims, 10 Drawing Sheets

HEAT EXCHANGER

CLAIM FOR PRIORITY

This application is a Continuation-in-Part of U.S. patent application Ser. No. 11/642,147, filed Dec. 20, 2006, and entitled Heat Exchanger.

TECHNICAL FIELD

The present disclosure is directed to a heat exchanger, and more particularly to a stacked plate heat exchanger and method of assembly thereof.

BACKGROUND

Plate-type heat exchangers are used for certain industrial applications in place of fin and tube or shell and tube type heat exchangers because they are less expensive and easier to make than most forms of heat exchangers. In one form of such plate-type heat exchangers, a plurality of primary surface plates are brazed together in a unitary structure with spacer frames located between adjacent plates and traversing a course adjacent to the plate peripheries. Flow of the two fluids involved in heat exchange is through alternate layers defined by the brazed plates. The space between the plates may be occupied by protuberances or fins formed in the plates to increase turbulence or heat exchange in the fluid flow. All of the fluid flowing in a given defined space is in contact with the plates to enhance heat transfer.

In order to handle larger heat loads, existing plate-type heat exchangers may be scaled up in size by adding more layers or using denser configurations of layers. However, one problem that arises with some designs is that the pressure loss across the heat exchanger increases. One technique used to decrease the pressure loss is to transversely supply each layer from a single conduit. The conduit is sized to minimize any pressure drops. An example of such a heat exchanger is disclosed in U.S. Pat. No. 5,911,273 to Brenner et al. ("the '273 patent"). The '273 patent discloses a heat exchanger having a stacked plate construction made of four distinct parts: a cover, a flow duct plate, a connection cover plate, and a connection plate. These parts are alternated and rotated in a stack assembly. A first fluid flows into the heat exchanger through a connection opening, into a single connection conduit, then transversely through fluidically parallel layers. A second fluid has a similar flow pattern, with the heat exchange occurring across the parallel layers of the stack assembly.

While the configuration of the '273 patent attempts to decrease pressure losses, it results in an increased manifold volume or supply conduit volume to heat exchanger volume ratio. As the size or the number of layers in the heat exchanger increases, the size of the manifold volume increases as well. For applications requiring a compact construction, this may prove to be unacceptable. In addition, there may be non-uniform heat exchange such that layers farthest from the supply conduit inlets may receive less flow than layers closest to the supply conduit inlets.

The present disclosure is directed to overcoming one or more of the problems set forth above.

SUMMARY

In one aspect, the present disclosure is directed to a heat exchanger. The heat exchanger includes a stack assembly with a plurality of plates and a plurality of frames arranged in an alternating stacked relationship with the plates along a stack direction. The stack assembly also includes a plurality of foam blocks disposed within the plurality of frames. A first and second fluid flow path extend through the stack assembly, with the first fluid flow path in thermal contact with the second fluid flow path and fluidly isolated from the second fluid flow path.

In another aspect, the present disclosure is directed to a method of manufacturing a heat exchanger including the steps of providing a plurality of plates having a plurality of first openings and providing a plurality of frames having a plurality of second openings. The method also includes the steps of positioning at least one of the plurality of foam blocks into each frame and alternately stacking the plates with the frames along a stack direction. The method also includes the steps of aligning the plurality of first openings with the plurality of second openings to define a first and a second fluid flow path extending through the stack assembly and sealingly interconnecting the stacked plates and frames to each other. The method also includes the step of fluidly isolating the first fluid flow path from the second fluid flow path.

In a third aspect of the present disclosure, a heat exchanger is provided. The heat exchanger includes a stack assembly with a plurality of plates and a plurality of frames arranged in an alternating stacked relationship with the plates along a stack direction. Each of the plates has a plurality of first openings, and each of the frames has a plurality of second openings. The stack assembly also includes a plurality of metal foam blocks disposed within the plurality of frames. A first and second fluid flow path extend through the stack assembly and the plurality of first and second openings, with the first fluid flow path in thermal contact with the second fluid flow path and fluidly isolated from the second fluid flow path.

DETAILED DESCRIPTION

Reference will now be made in detail to the drawings. Wherever possible, the same reference numbers will be used throughout the drawings to refer to the same or like parts.

Figure 1:
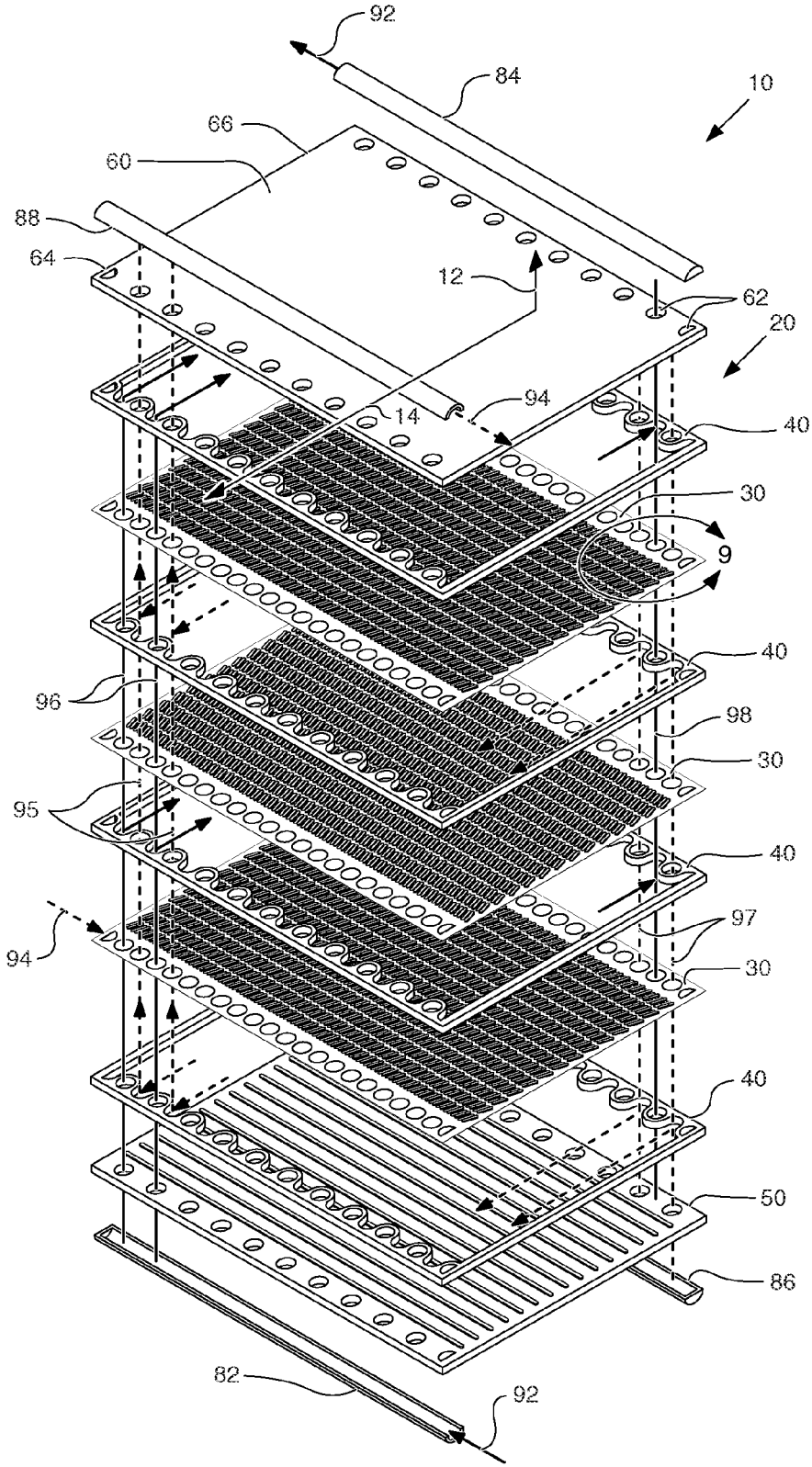
FIG. 1 is an exploded perspective view of one exemplary embodiment of a heat exchanger.

FIG. 1 shows a heat exchanger 10. Heat exchanger 10 includes a stack assembly 20 made up of alternating layers of plates 30 and frames 40, a bottom cover 50, a top cover 60, and manifolds 82, 84, 86, and 88. Heat exchanger 10 is shown assembled along a stack direction 12 that is oriented vertically, but this is only for purposes of illustration.

Stack assembly 20 is made up of layers of plates 30 and frames 40. As seen in FIG. 1, plates 30 are flat plates formed of a thin sheet of material such as stainless steel, aluminum, brass, copper, bronze, or any other material with desired heat transfer characteristics. In addition, while plates 30 are depicted as rectangular, other shapes may also be used. In one exemplary embodiment plates 30 have dimensions of 279 mm long by 179 mm wide by 0.1 mm thick, although plates 30 of other sizes may also be used. Plates 30 may be formed by methods known in the art, such as stamping, laser beam cutting, water torch cutting, eroding, etc.

Figure 4:
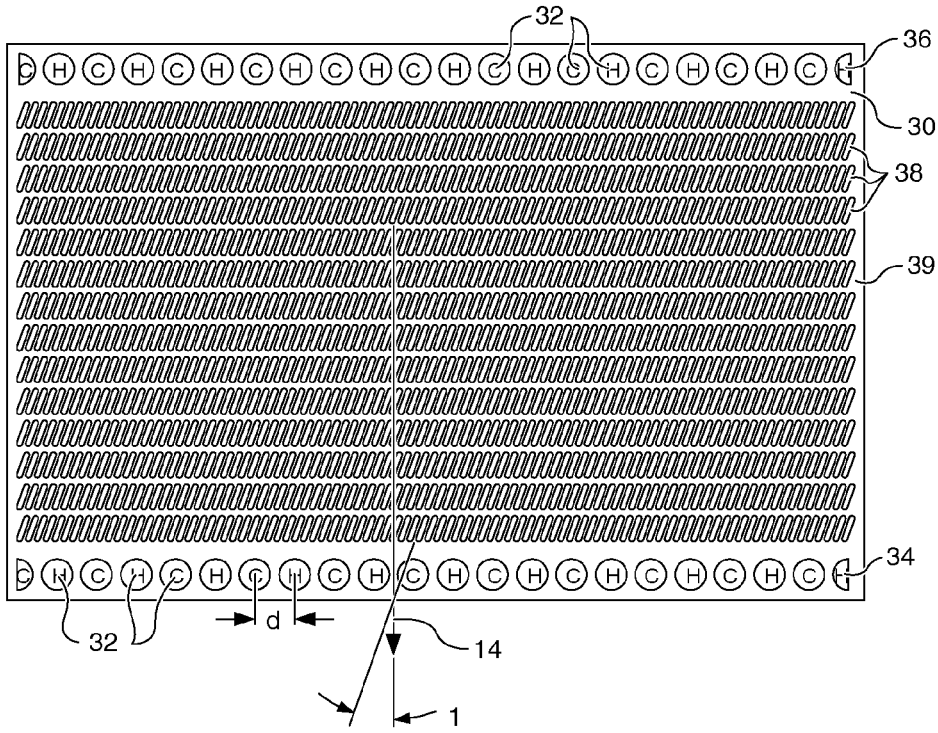
FIG. 4 is a plan view of a plate of the heat exchanger of FIG. 1.

As seen in FIG. 4, a first and second row 34, 36 of openings 32 are positioned along parallel edges of plate 30. Openings 32 in each of first and second row 34, 36 are spaced a distance of "d" apart. In one exemplary embodiment, openings 32 are symmetrically aligned on opposite edges of plate 30, although other configurations may also be used.

Figure 9:
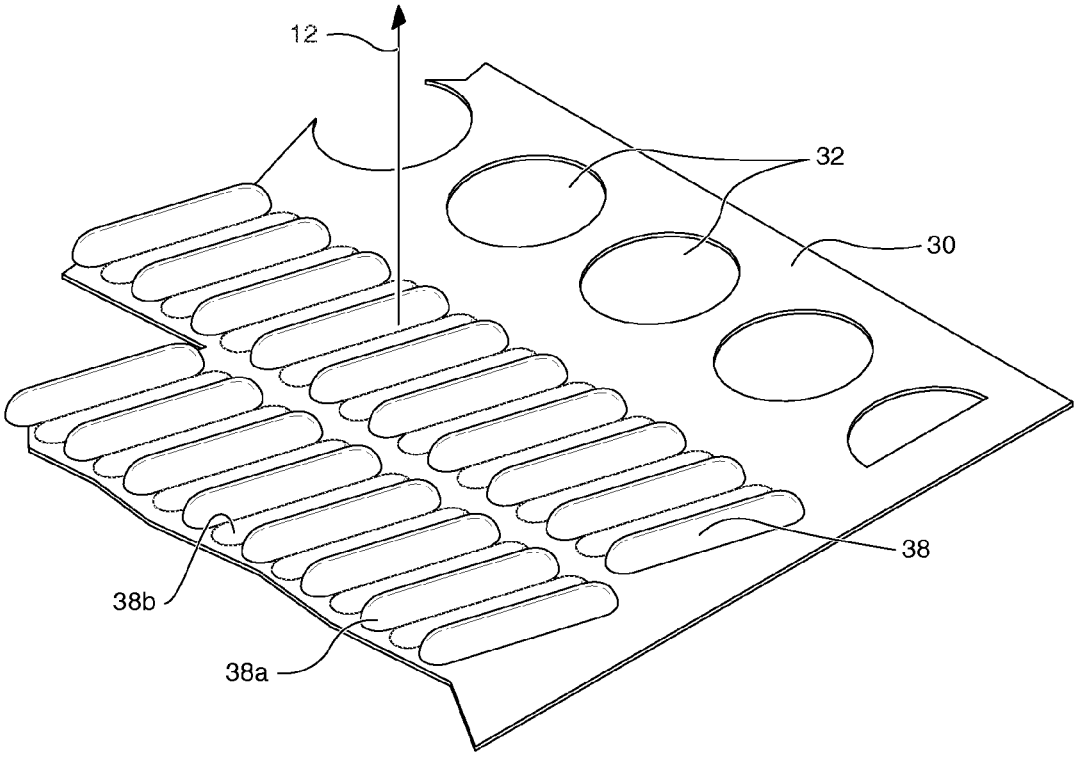
FIG. 9 is a detail view of the plate of FIG. 1.

In addition, as seen in FIGS. 1, 4, and 9, plates 30 are integrally formed with a plurality of turbulators 38 arranged in an array 39. As seen in FIG. 9, plates 30 may be formed such that adjacent turbulators 38 have opposite configurations with respect to stack direction 12. One turbulator 38*a* may project out of plate 30 along stack direction 12, while an adjacent turbulator 38*b* may project into plate 30 along stack direction 12. In one exemplary embodiment, turbulators 38 have a height of 1 mm, or one half the thickness of frames 40. As seen in FIG. 4, the turbulators 38 may be oriented at an angle of "θ1" to a transverse direction 14, which is approximately twenty degrees in one exemplary embodiment.

Figure 3:
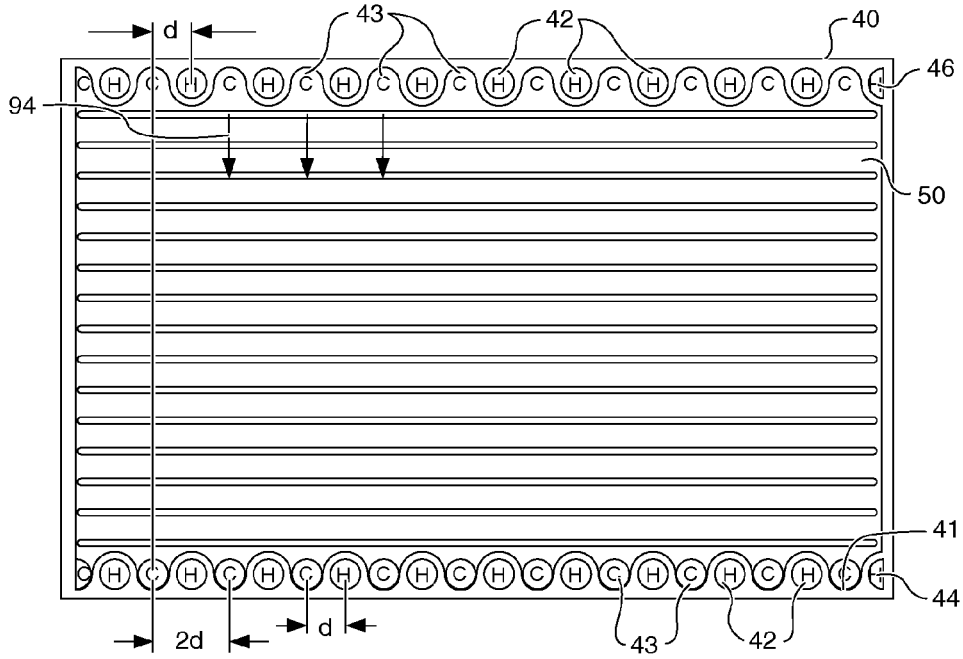
FIG. 3 is a plan view of a frame layered on the cover of FIG. 2.
Figure 5:
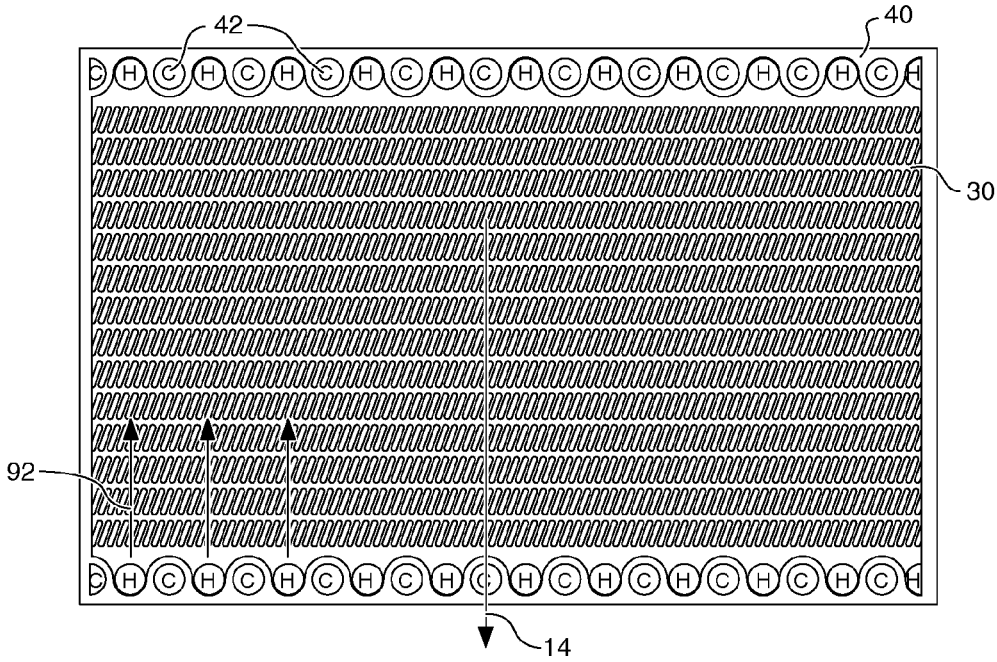
FIG. 5 is a plan view of a frame, which is rotated 180 degrees about a stack direction from the frame of FIG. 3, layered on the plate of FIG. 4.
Figure 7:
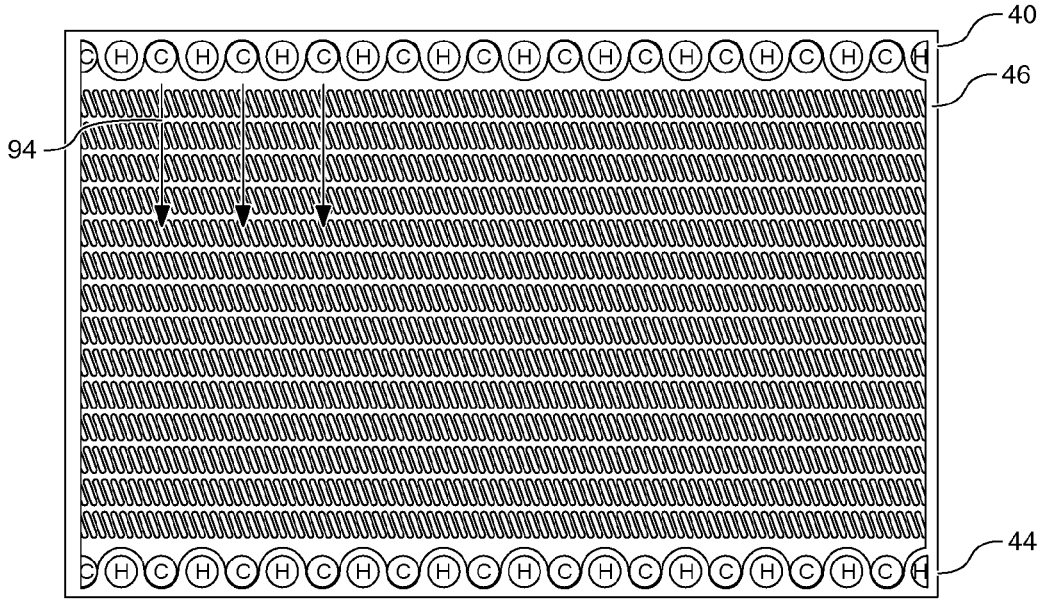
FIG. 7 is a plan view of a frame layered on the plate of FIG. 6.

As seen in FIGS. 5 and 7, frames 40 are sized to have similar outer dimensions to that of plates 30, and may also be made of similar materials. Frames 40 also may have a thickness of approximately twice the height of turbulator 38, which in one exemplary embodiment is 2 mm, although other thicknesses may be used. As seen in FIG. 3, frames 40 also have a first and second row 44, 46 of alternating openings 42 and voids 43 that are positioned along parallel edges. Openings 42 in each of first and second row 44, 46 are spaced a distance of "2d" apart, and are enclosed within the interior periphery 41 of frame 40. Voids 43 are also formed in the interior periphery 41 of frame 40 and are spaced a distance of "2d" apart, such that each opening 42 is spaced a distance of "d" from an adjacent void 43. This spacing between voids 43 and openings 42 is maintained for both first row 44 and second row 46. In addition, the openings 42 and voids 43 in first and second row 44, 46 may be symmetrically aligned along parallel edges of frame 40, such that the openings 42 and voids 43 in the first row 44 are mirror images of the openings 42 and voids 43 in the second row 46. Openings 42 and voids 43 are sized to match the openings 32 in plates 30, although they may be slightly increased or decreased to facilitate alignment and sealing.

Figure 6:
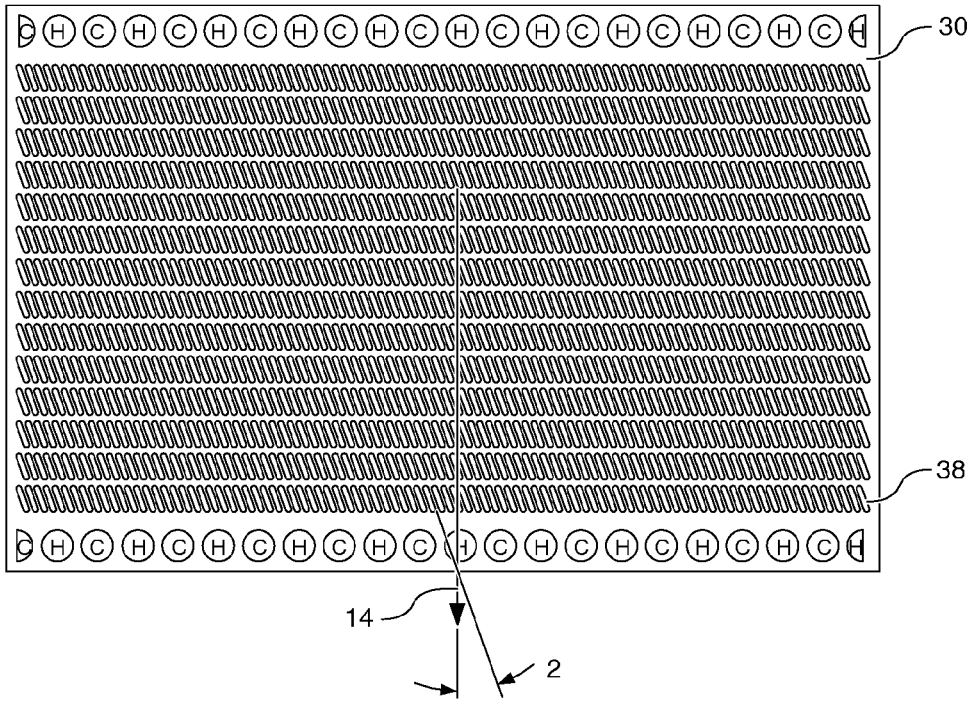
FIG. 6 is a plan view of a plate that is rotated 180 degrees about a transverse direction from the plate of FIG. 4.

As seen in FIG. 1, stack assembly 20 begins with a frame 40. A first plate 30 is aligned on the frame 40. A second frame 40, which is rotated 180 degrees about the stack direction 12 from the first frame 40, is placed on the plate 30. A second plate 30, rotated 180 degrees about a transverse direction 14, is placed onto the frame 40. As seen in FIG. 6, the turbulators 38 of the second plate 30 are symmetrically disposed about the transverse direction 14, such that "θ2" is equal to the "θ1" shown in FIG. 1. The stack continues in this fashion, alternating frames 40 and plates 30, with successive frames 40 and plates 30 rotated 180 degrees about a transverse direction 14 from the preceding one.

Figure 2:
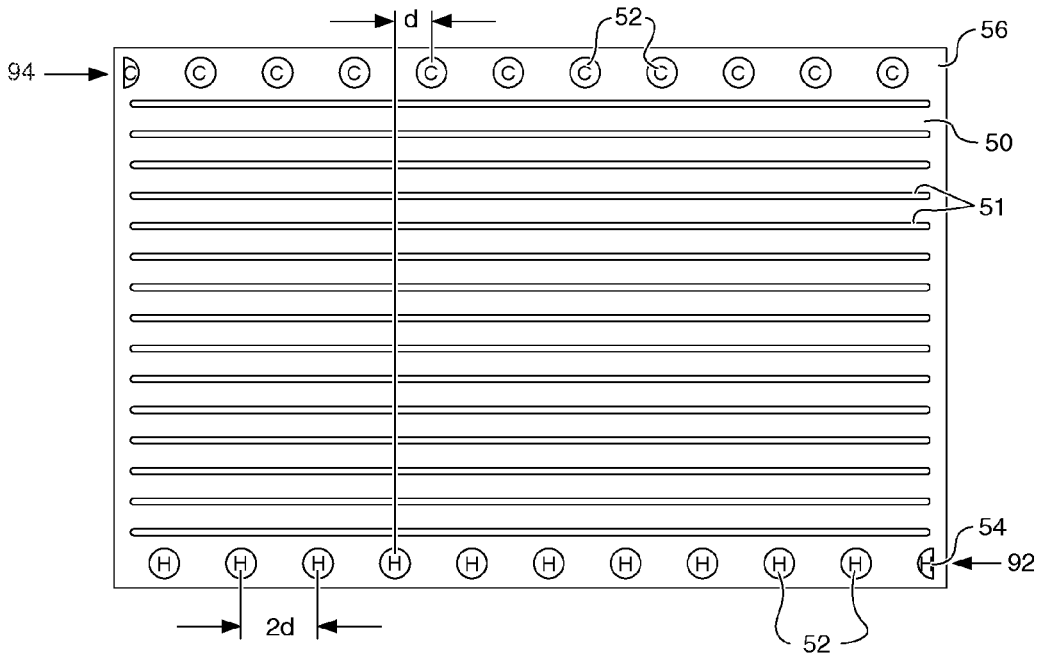
FIG. 2 is a plan view of a cover for the heat exchanger of FIG. 1.

Stack assembly 20 is placed onto a bottom cover 50. As seen in FIG. 2, bottom cover 50 has a first and second row 54, 56 of openings 52 positioned along parallel edges. Openings in first and second row 52 are positioned a distance of "2d" apart. In addition, a series ridges 51 may extend across an inner surface of bottom cover 50. Depending on the orientation, these ridges 51 may serve to direct the flow of fluid across the cover, turbulate the water, and/or increase heat exchange. The openings 52 in first and second row 54, 56 of bottom cover 50 are laterally offset a distance of "d", such that the first and second rows 54, 56 of openings 52 are not symmetric along the length of the cover. Bottom cover 50 may be sized with substantially the same outer dimensions as frame 40 or plate 30.

As seen in FIG. 1, a top cover 60 is placed at the top of the stack assembly 20. Top cover 60 has a first and second row 64, 66 of openings 62 positioned on parallel edges. In one exemplary embodiment, top cover 60 is identical to bottom cover 50. However, in assembling top cover 60 to stack assembly 20, top cover 60 is rotated 180 degrees about a transverse direction 14 with respect to bottom cover 50. Other aspects of top cover 60 are similar to bottom cover 50, shown in FIGS. 1 and 2 and described above.

As the heat exchanger 10 is stacked, the alignment of openings 32, 42, 52 and voids 43 in the plates 30, frames 40, and covers 50, 60 define a plurality of fluid channels 95, 96, 97, 98 that extend through the stack assembly 20 along the stack direction 12. Fluid channels 95, 96 are defined in the first row 34, 44, 54, 64 of plates 30, frames 40, and covers 50, 60, while fluid channels 97, 98 are defined in the second row 36, 46, 56, 66 of plates 30, frames 40, and covers 50, 60. In one exemplary embodiment, fluid channels 95, 96 alternate openings 32, 42, 52, 62 and voids 43 throughout first row 34, 44, 54, 64, so that each fluid channel 95 is adjacent a fluid channel 96. Similarly, fluid channels 97, 98 alternate openings 32, 42, 52, 62 and voids 43 throughout second row 36, 46, 56, 66, so that each fluid channel 97 is adjacent a fluid channel 98.

As seen in FIG. 1, each of manifolds 82, 84, 86, and 88 is positioned over the first and second row 54, 56, 64, 66 of openings 52, 62 of top and bottom covers 60, 50. Manifolds 82, 84, 86, and 88 each serve as fluid conduits. Manifolds 82 and 84 function as an inlet and outlet, respectively, for a first fluid, such as hot engine oil. Manifolds 86 and 88 function as an inlet and outlet, respectively, for a second fluid, such as coolant.

Figure 8:
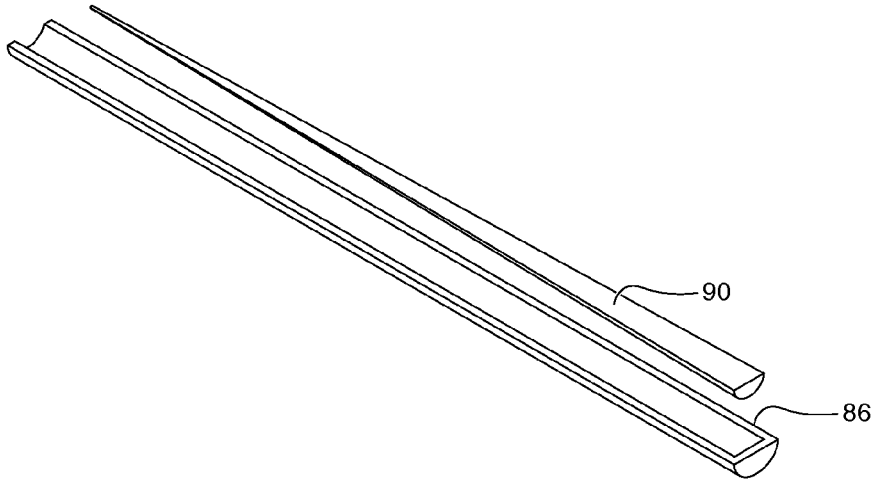
FIG. 8 is a perspective view of a tapered insert that may be placed in the manifolds or fluid channels of FIG. 1.

As seen in FIG. 8, tapered inserts 90 may be placed in manifolds 82, 84, 86, and 88. In one exemplary embodiment, inserts 90 are placed in the first and second fluid outlet manifolds 84 and 88. These inserts serve to equalize the pressure drop across the heat exchanger so that there is a substantially equal flow and heat exchange between fluids across the length and height of the heat exchanger 10. Alternately, inserts 90 may be placed in the fluid channels 95, 96, 97, 98 extending along the stack direction 12, designated as "h" and "c" in first and second row 34, 36 in FIG. 4. The inserts 90 may be integrally formed with manifolds 82, 84, 86, and 88, or sealed to the manifolds 82, 84, 86, and 88 in a separate step. Inserts 90 may be made from stainless steel, aluminum, brass, copper, bronze, or other material with desired heat transfer characteristics.

Figure 10:
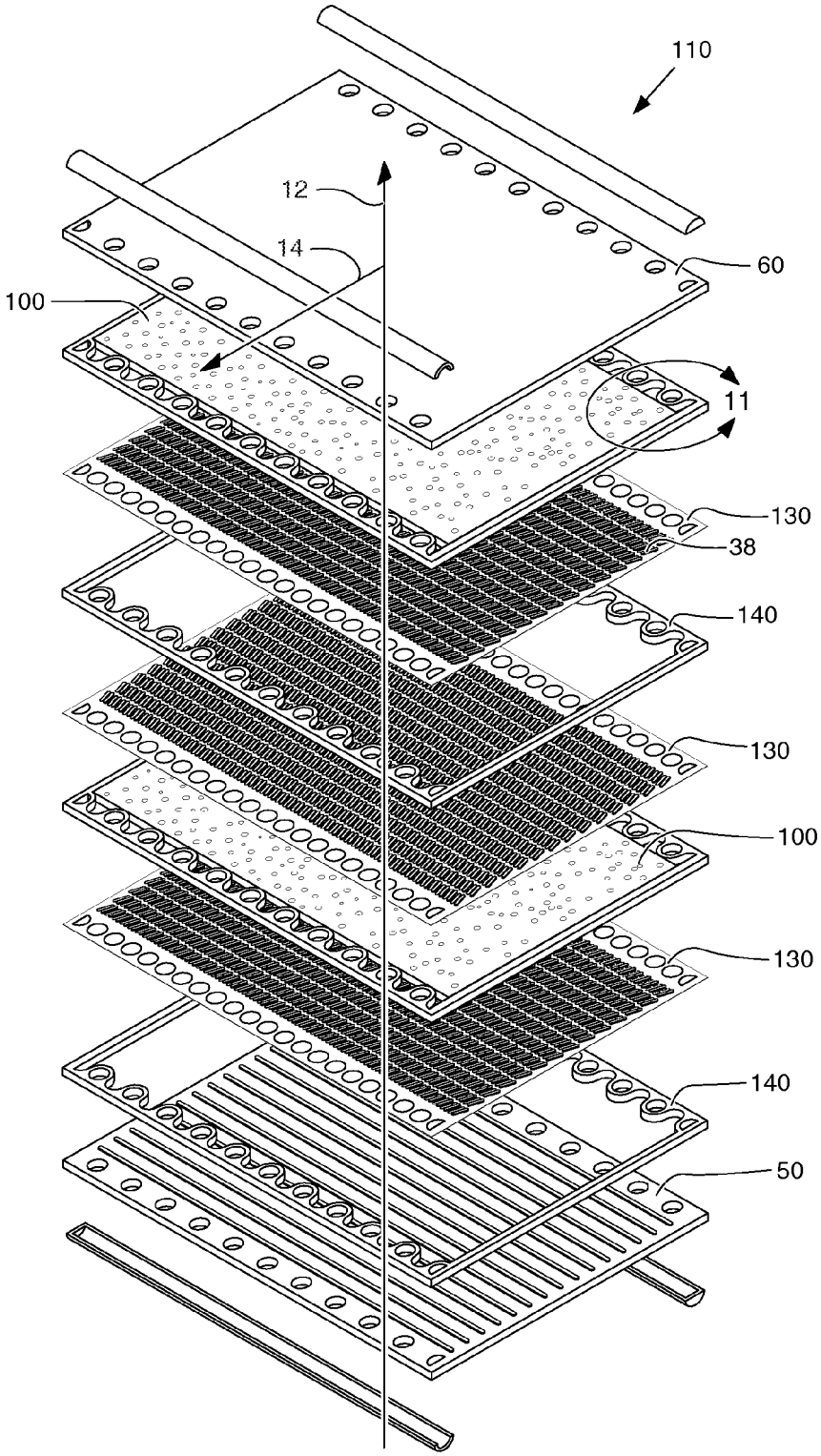
FIG. 10 is an exploded perspective view of another exemplary embodiment of the heat exchanger, shown with foam inserts.
Figure 11:
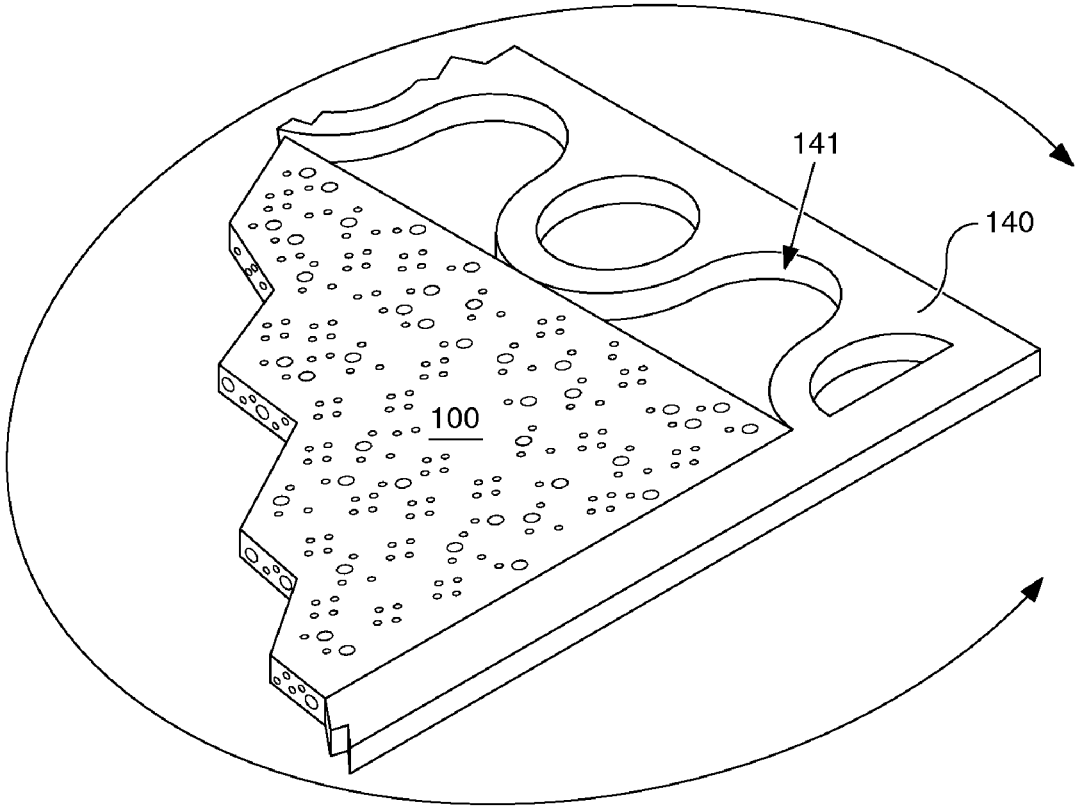
FIG. 11 is a detail view of the inserts of FIG. 10.

FIGS. 10-11 illustrate another exemplary embodiment of the present disclosure. Foam inserts 100 are placed within the interior periphery 141 of frames 140. Foam inserts 100 may be made from a porous metal or carbon as described in U.S. Pat. Nos. 3,616,841 and 3,946,039 to Walz, U.S. Pat. App. No. 2004/0226702 to Toonen, or U.S. Pat. No. 6,673,328 to Klett. Inserts 100 have large surface area per unit volumes (approximately 1600 square feet/cubic foot). These inserts may be placed in the interior periphery 141 of every frame 140, or only used with alternate frames 140, as is shown in FIG. 10. As is shown in FIG. 10, plates 130 are formed with only a single surface of turbulators 38. Other aspects of heat exchanger 110 are similar to the heat exchanger 10 shown in FIG. 1 and described above.

Figure 12:
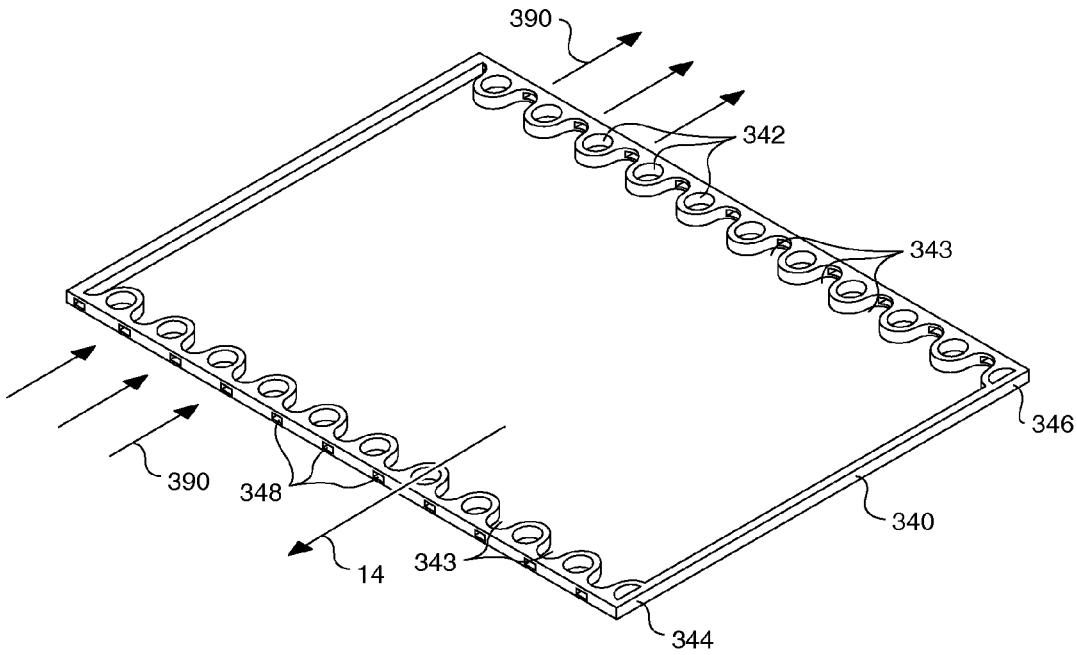
FIG. 12 is a perspective view of a frame that may be used with another exemplary embodiment of a heat exchanger.
Figure 13:
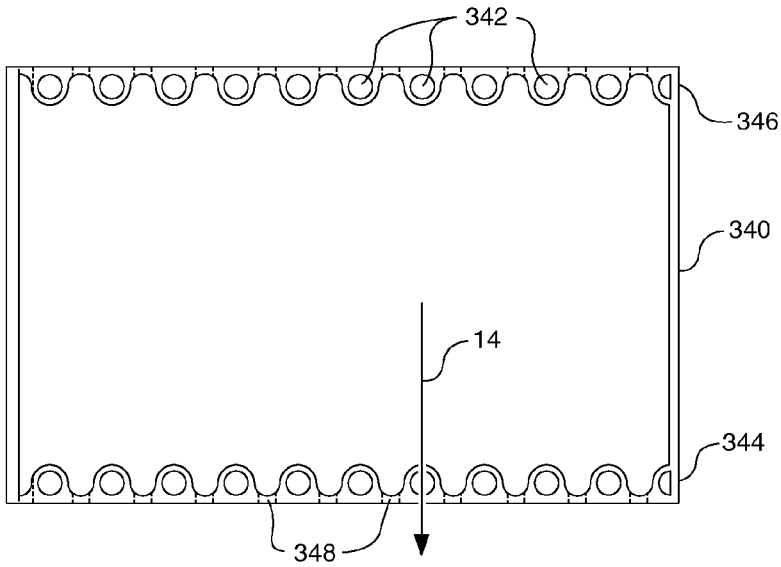
FIG. 13 is a plan view of the frame of FIG. 12.

In another exemplary embodiment, a gas to fluid heat exchanger (not shown) may be constructed by substituting layers of frames 340, as shown in FIGS. 12 and 13, with every other frame 40, 140 in heat exchangers 10, 110 as shown in FIGS. 1 and 10. Similar to frames 40 and 140, frame 340 has a first and second row 344, 346 of alternating openings 342 and voids 343 that are positioned along parallel edges. A plurality of transverse openings 348 extend through the voids 343 in both the first and second row 344, 346. These transverse openings 348 permit a transverse flow 390 along the transverse direction 14 to flow past the turbulators 38 and through the frame 340, providing heat transfer to alternate plates 30, 130. These transverse openings 348 open the heat exchanger to ambient air, allowing for an air-to-fluid heat exchanger. Such a heat exchanger could also eliminate one set of manifolds.

Heat exchangers 10, 110, 410 may be formed using a brazing operation. Before assembly, a flux is applied to the peripheries of each of manifolds 82, 84,86, 88; covers 50, 60, frames 40, and plates 30. Thin sheets of solder may be placed between each layer to ensure a solder seal extending around the entire periphery. After assembly, the heat exchanger 10, 110 may be clamped together and heated to form a sealed unit. Alternately, the heat exchanger 10, 110 may be formed from any other technique known in the art, such as welding.

Figure 14:
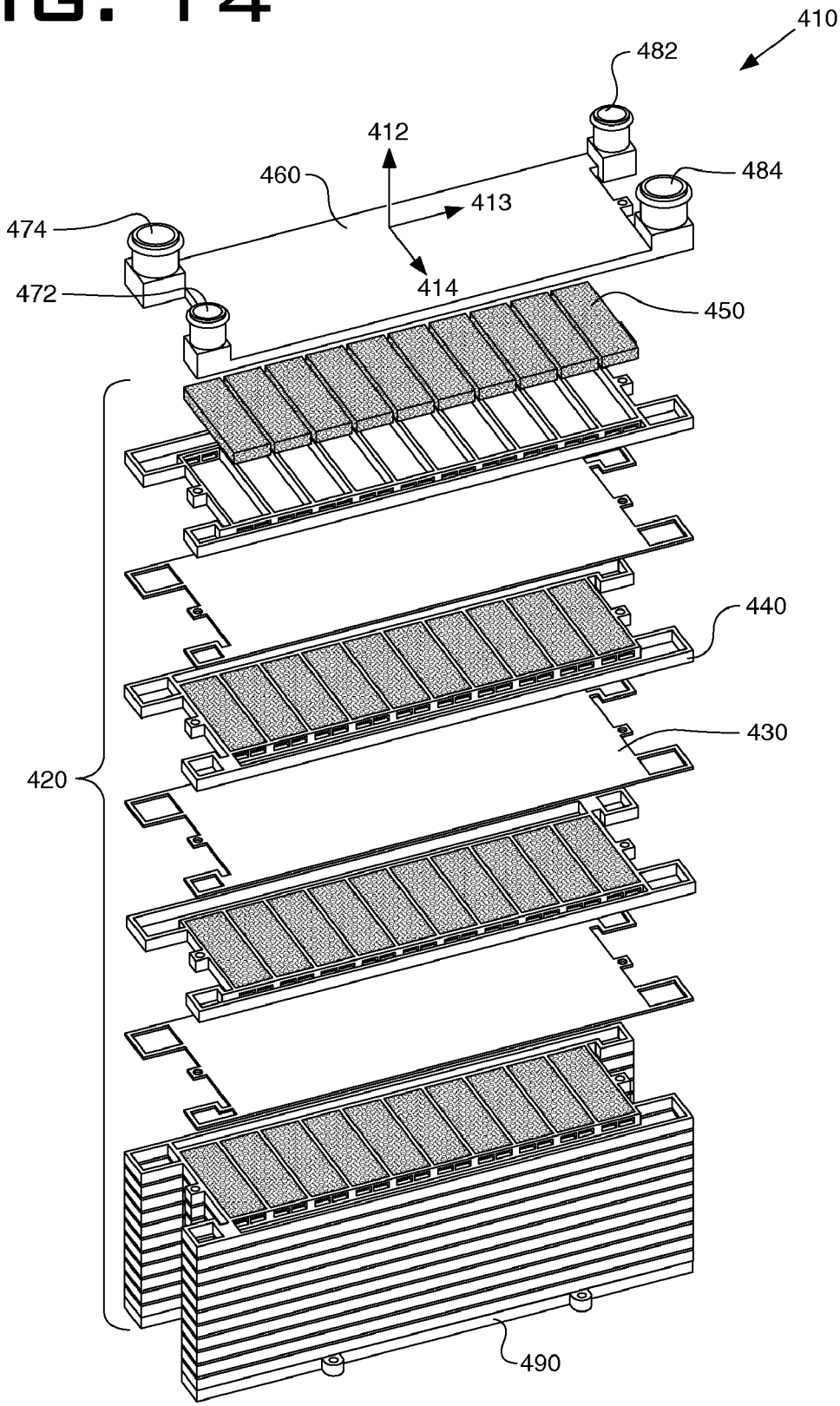
FIG. 14 is an exploded perspective view of another exemplary embodiment of a heat exchanger, shown with foam inserts.
Figure 15:
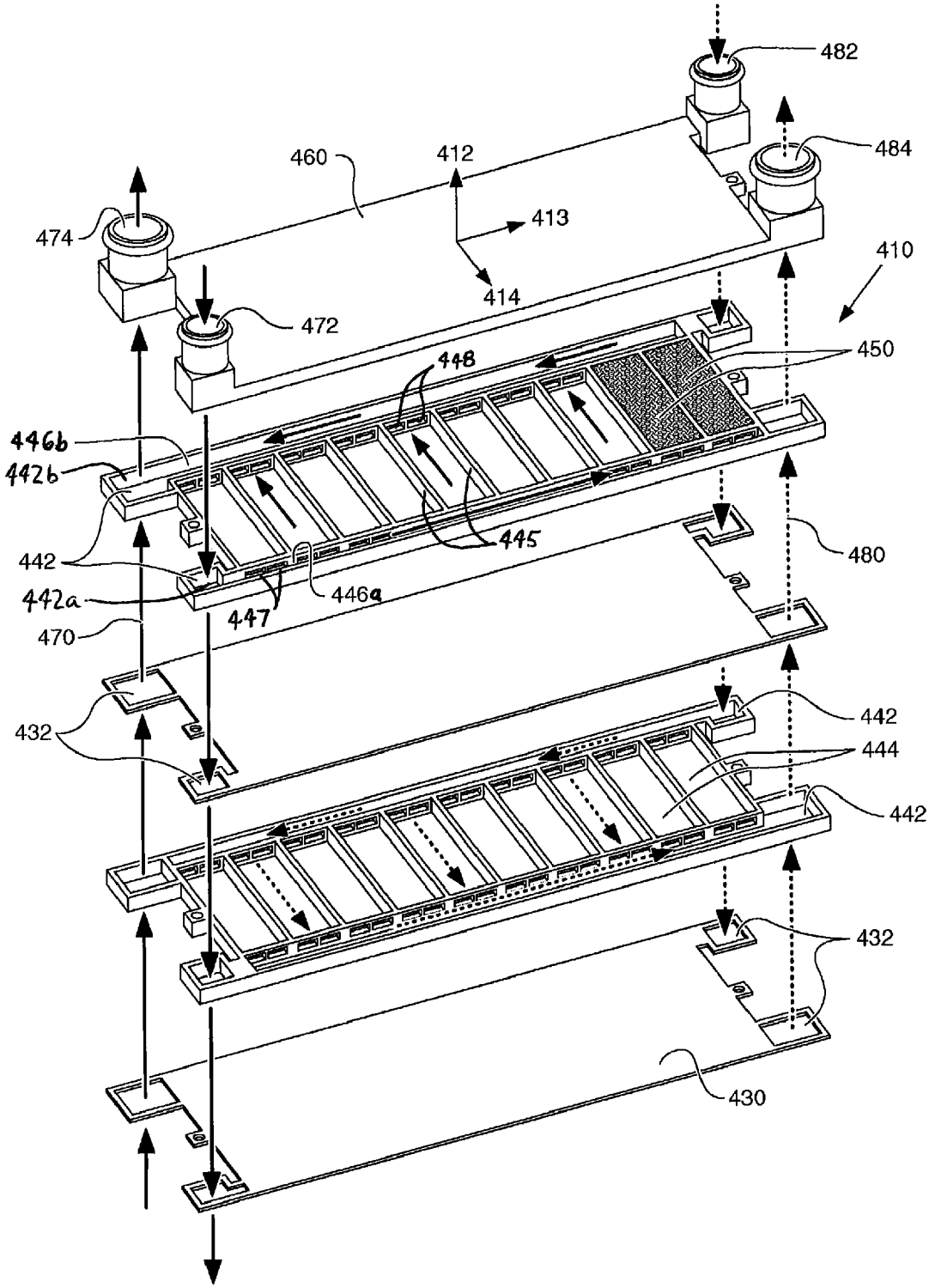
FIG. 15 is an exploded detail view of the heat exchanger of FIG. 14.

FIGS. 14-15 illustrate another embodiment of a fluid-to-fluid heat exchanger 410, such as an oil cooler. Heat exchanger 410 includes a stack assembly 420 made up of alternating layers of plates 430 and frames 440, a base plate 490, and a manifold plate 460. Heat exchanger 410 is shown assembled along a stack direction 412 that is oriented vertically, but this is only for purposes of illustration. As seen in FIG. 15, a plurality of first openings 432 are positioned in each plate 430 and a plurality of second openings 442 are positioned in each frame 440. The second openings may include a frame inlet opening 442*a* and a frame outlet opening 442*b*. In addition, each frame 440 has a plurality of transverse channels 444 that extend across a transverse direction 414, with adjacent transverse channels 444 separated by transverse channel walls 445. The frames 440 also have a plurality of longitudinal channels 446 that extend across a longitudinal direction 413. The longitudinal direction is substantially perpendicular to the stack direction 412, and the transverse direction 414 is substantially perpendicular to both the stack direction 412 and the longitudinal direction 413, as shown in FIG. 15. The longitudinal channels 446 include a longitudinal inlet channel 446*a* that fluidly communicates with the frame inlet opening 442*a* and a longitudinal outlet channel 446*b* the fluidly communicates with the frame outlet opening 442*b*. As shown in FIGS. 14-15, the transverse channels 444 fluidly communicate between the longitudinal inlet channel 446*a* and the longitudinal outlet channel 446*b*. More specifically, in the illustrated embodiment, each transverse channel 444 includes at least one transverse channel inlet 447 fluidly communicating with the longitudinal inlet channel 446*a* and at least one transverse channel outlet 448 fluidly communicating with the longitudinal outlet channel 446*b*. Each longitudinal channel 446 is also fluidly coupled to one of the second openings 442 through orifices (not shown) in the frames 440.

Stack assembly 420 begins with the base plate 490. A first frame 440 is aligned on the base plate 490. Foam blocks 450 are positioned within each of the transverse channels 444 of the frame 440. A first plate 430 is then aligned onto the frame 440 such that the plurality of first openings 432 is aligned with the plurality of second openings 442. A second frame 440, rotated 180 degrees about the stack direction 412, is placed onto the plate 430. Foam blocks 450 are again positioned within each of the transverse channels 444 of the second frame 440, which is capped with a second plate 430. The second plate 430 is also rotated 180 degrees about the stack direction 412 with respect to the first plate 430. After the desired number of layers is stacked, a manifold plate 460 is positioned on top of the uppermost frame 440. Alignment rods (not shown) may be used to help align the plates 430, frames 440, and manifold plate 460.

The manifold plate 460 has first and second fluid inlets 472, 482, as well as first and second fluid outlets 474, 484. The inlets 472, 482, and outlets 474, 484 are each aligned with the one of the plurality of first and second openings 432, 442 in the plurality of plates 430 and frames 440 to form a first and second fluid flow path 470, 480.

INDUSTRIAL APPLICABILITY

In operation, a first and a second fluid flow path 92, 94 are defined through the heat exchanger 10, 110. A first fluid, such as heated engine oil, follows first fluid flow path 92 and enters through manifold 82. From manifold 82, the first fluid next flows into the fluid channels 96 extending through the stack assembly 20 defined by the first row 54 of openings 52 in the bottom cover 50 (as seen in FIG. 2, designated by "h"). From the flow channels, the first fluid flows through voids 43 in the first row 44 of alternate frames 40, 140 flowing across the turbulators 38 of primary surface sheets or plates 30, 130. The flow path 92 continues into voids 43 in the second row 46 of alternate frames 40, 140 and back through fluid channels 98 extending through the stack assembly 20 ("designated by "h" in the second row 36 in FIG. 4). Flow path 92 continues from the fluid channels 98 in the second row to manifold 84, where it exits after being cooled by the heat exchange with the second fluid.

Similarly, a second fluid, such as coolant, follows second fluid flow path 94 and enters through manifold 86. From manifold 86, the second fluid next flows into fluid channels 97 extending through the stack assembly 20 defined by the second row 56 of openings 52 in the bottom cover 50 (as seen in FIG. 2, designated by "c"). From the fluid channels 97, the second fluid flows through voids 43 in the second row 46 of alternate frames 40, 140 flowing across the turbulators 38 of primary surface sheets or plates 30. The flow path 94 continues into voids 43 in the first row 44 of alternate frames 40, 140 and back through fluid channels 95 extending through the stack assembly 20 ("designated by "c" in the first row 36 in FIG. 4). Flow path 94 continues from the fluid channels 95 in the second row to manifold 88, where it exits after being heated by the heat exchange with the first fluid. Alternately, the first and second fluid flow paths 92, 94 may be reversed. In addition, the first and second fluid inlets may feed into the upper manifolds 88, 84 instead of the lower manifolds 82, 86, or any other combination. Fluid flow path 92 is fluidically isolated from fluid flow path 94.

Foam inserts 100 or turbulators 38 may also be used to increase the heat exchange that occurs across primary surface sheet or plate 30, 130. Additional heat exchange may also occur in alternating channels in each of the first and second rows (as seen in FIG. 2, adjacent "h" and "c").

Referring now to FIGS. 14-15, the operation of heat exchanger 410 will be described. The first and second fluid flow paths 470, 480 of heat exchanger 410 are fluidly isolated from and in thermal contact with each other across the plates 430. The first fluid, such as heated engine oil, follows first fluid flow path 470 and enters the manifold plate 460 through the first fluid inlet 472. The first fluid flow path 470 extends down the stack direction 412 through the frame inlet opening 442 in alternating frames 440. As seen in FIG. 15, the first fluid flow path 470 continues along the longitudinal inlet channel 446*a* in alternating frames 440. The first flow path 470 flows across those alternating frames 440 through the foam blocks 450 in the transverse channels 444 and back through the longitudinal outlet channel 446*b* in each of the alternating frames 440, into the frame outlet opening 442*b* and back out of the stack assembly 420 through the first fluid outlet 474.

The second fluid, which may be a coolant such as water or ethylene glycol, follows the second flow path 480 and enters the manifold plate 460 through the second fluid inlet 482. The second fluid flow path 480 then extends down the stack direction 412 through one of the openings 442 in the first frame 440, through one of the openings 432 in plate 430 and into the frame inlet opening 442*a* in the second frame 440 (which is rotated 180 degrees about the stack direction relative to the first frame 440). The second fluid flow path 480 continues along longitudinal inlet channel 446*a* in each of the alternating frames 440. The second flow path 480 flows across alternating frames 440 through the foam blocks 450 in the transverse channels 444 and back through the longitudinal outlet channel 446 of each of the alternating frames 440, into the frame outlet opening 442*b* and back up out of the stack assembly 420 through the second fluid outlet 484.

The foam blocks 450, positioned within the transverse channels 444, increase the heat transfer that takes place in this counterflow arrangement between the first fluid flow path 470 and the second fluid flow path 480. The foam blocks 450 may be compressed into the transverse channels 444 such that an outer portion (not shown) of the foam blocks 450 has a lower percentage of void space than an inner portion (also not shown). The foam ligaments (not shown) of the foam blocks 450 have a large surface area per unit volume of foam which results in higher heat conduction from the hot side of the plate 430 to the cold side. The foam ligaments also turbulate the fluid flow which leads to higher heat transfer rates. The metal foam ligaments, having a much higher thermal conductivity than the fluid, increase the effective conductivity of the fluid-metal foam mixture.

It will be apparent to those having ordinary skill in the art that various modifications and variations can be made to the disclosed heat exchanger without departing from the scope of the invention. Other embodiments of the invention will be apparent to those having ordinary skill in the art from consideration of the specification and practice of the invention disclosed herein. It is intended that the specification and examples be considered as exemplary only, with a true scope of the invention being indicated by the following claims and their equivalents.

What is claimed is:

1. A heat exchanger comprising:
- a stack assembly including:
  - a plurality of plates, each of the plates having a plurality of first openings; and
  - a plurality of frames arranged in an alternating stacked relationship with the plates along a stack direction, each of the frames having:
    - a plurality of second openings including a frame inlet opening and a frame outlet opening;
    - a longitudinal inlet channel fluidly communicating with the frame inlet opening and extending in a longitudinal direction substantially perpendicular to the stack direction;
    - a longitudinal outlet channel fluidly communicating with the frame outlet opening; and
    - at least one transverse channel extending in a transverse direction substantially perpendicular to both the stack direction and the longitudinal direction, the transverse channel fluidly communicating between the longitudinal inlet channel and the longitudinal outlet channel;
- a first fluid flow path extending through the stack assembly and the plurality of first and second openings; and
- a second fluid flow path extending through the stack assembly and the plurality of first and second openings and in thermal contact with the first fluid flow path and fluidly isolated from the first fluid flow path.

2. The heat exchanger of claim 1, further comprising a foam block disposed in the transverse channel.

3. The heat exchanger of claim 2, in which the foam block comprises a metal foam.

4. The heat exchanger of claim 2, in which the foam block has an inner portion and an outer portion, and the outer portion has a lower percentage of void space than the inner portion.

5. The heat exchanger of claim 1, in which the plurality of plates and frames have a length extending in the longitudinal direction that is greater than a width extending in the transverse direction.

6. The heat exchanger of claim 1, in which the stack assembly is brazed together.

7. The heat exchanger of claim 1, in which alternate frames are rotated 180 degrees about the stack direction.

8. A heat exchanger comprising:
- a stack assembly including:
  - a plurality of plates, each of the plates having a plurality of first openings; and
  - a plurality of frames arranged in an alternating stacked relationship with the plates along a stack direction, each of the frames having:
    - a plurality of second openings including a frame inlet opening and a frame outlet opening;
    - a longitudinal inlet channel fluidly communicating with the frame inlet opening and extending in a longitudinal direction substantially perpendicular to the stack direction;
    - a longitudinal outlet channel fluidly communicating with the frame outlet opening; and
    - a plurality of transverse channels extending in a transverse direction substantially perpendicular to both the stack direction and the longitudinal direction separated by transverse channel walls, each transverse channel having a transverse channel inlet fluidly communicating with the longitudinal inlet channel and a transverse channel outlet fluidly communicating with the longitudinal outlet channel;

a first fluid flow path extending through the stack assembly and the plurality of first and second openings; and a second fluid flow path extending through the stack assembly and the plurality of first and second openings and in thermal contact with the first fluid flow path and fluidly isolated from the first fluid flow path.

9. The heat exchanger of claim 8, further comprising a plurality of foam blocks disposed in the plurality of transverse channels.

10. The heat exchanger of claim 9, in which the plurality of foam blocks comprises a metal foam.

11. The heat exchanger of claim 9, in which each of the foam blocks has an inner portion and an outer portion, and the outer portion has a lower percentage of void space than the inner portion.

12. The heat exchanger of claim 9, in which each foam block extends in the longitudinal direction to engage adjacent transverse channel walls.

13. The heat exchanger of claim 8, in which the plurality of plates and frames have a length extending in the longitudinal direction that is greater than a width extending in the transverse direction.

14. The heat exchanger of claim 8, in which the stack assembly is brazed together.

15. The heat exchanger of claim 8, in which alternate frames are rotated 180 degrees about the stack direction.

16. A heat exchanger comprising:

a stack assembly including:

a plurality of plates, each of the plates having a plurality of first openings; and a plurality of frames arranged in an alternating stacked relationship with the plates along a stack direction, each of the frames having:

a plurality of second openings including a frame inlet opening and a frame outlet opening;

a longitudinal inlet channel fluidly communicating with the frame inlet opening and extending in a longitudinal direction substantially perpendicular to the stack direction;

a longitudinal outlet channel fluidly communicating with the frame outlet opening; and a plurality of transverse channels extending in a transverse direction substantially perpendicular to both the stack direction and the longitudinal direction separated by transverse channel walls, each transverse channel having a transverse channel inlet fluidly communicating with the longitudinal inlet channel and a transverse channel outlet fluidly communicating with the longitudinal outlet channel;

a plurality of metal foam blocks disposed in the plurality of transverse channels;

a first fluid flow path extending through the stack assembly and the plurality of first and second openings; and a second fluid flow path extending through the stack assembly and the plurality of first and second openings and in thermal contact with the first fluid flow path and fluidly isolated from the first fluid flow path.

17. The heat exchanger of claim 16, in which each of the foam blocks has an inner portion and an outer portion, and the outer portion has a lower percentage of void space than the inner portion.

18. The heat exchanger of claim 16, in which each foam block extends in the longitudinal direction to engage adjacent transverse channel walls.

19. The heat exchanger of claim 16, in which the plurality of plates and frames have a length extending in the longitudinal direction that is greater than a width extending in the transverse direction.

20. The heat exchanger of claim 16, in which alternate frames are rotated 180 degrees about the stack direction.

* * * * *